United States Patent [19]

Valiulis

[11] Patent Number: 4,533,819

[45] Date of Patent: Aug. 6, 1985

[54] DUAL MANDREL ELECTRIC CURLING IRON WITH SEPARATE ANGULARLY ADJUSTABLE HAIR CLAMPS

[76] Inventor: Mary M. Valiulis, 735 Napoleon, Rockford, Ill. 61103

[21] Appl. No.: 627,078

[22] Filed: Jul. 2, 1984

[51] Int. Cl.[3] ..... A45D 1/02; H05B 3/02

[52] U.S. Cl. ..... 219/225; 132/9; 132/31 R; 132/32 R; 132/37 R; 132/118; 219/230; 219/243; 219/533

[58] Field of Search ..... 219/222–226, 219/230, 533, 243; 132/9, 117, 118, 31 R, 32 R, 34 R, 37 R, 37 A

[56] References Cited

U.S. PATENT DOCUMENTS

| | | | |
|---|---|---|---|
| 930,586 | 8/1909 | Wilmot | 219/225 X |
| 1,031,604 | 7/1912 | Wilmot | 132/32 R |
| 1,056,987 | 3/1913 | Gough | 219/222 X |
| 1,648,740 | 11/1927 | O'Malley | 132/32 A |
| 3,859,497 | 1/1975 | McNair | 132/37 R X |
| 3,955,064 | 5/1976 | Demetrio et al. | 219/225 |
| 4,151,850 | 5/1979 | Nathe | 219/225 X |
| 4,479,047 | 10/1984 | Khaja et al. | 219/225 |

FOREIGN PATENT DOCUMENTS

| | | | |
|---|---|---|---|
| 2065471 | 7/1981 | United Kingdom | 219/225 |

*Primary Examiner*—A. Bartis

*Attorney, Agent, or Firm*—Leydig, Voit, Osann, Mayer & Holt, Ltd.

[57] ABSTRACT

A curling iron in which two electrically heated winding mandrels with separate independently operable pivoted hair clamps project in spaced side-by-side relation from a handle. The mandrels are angularly adjustable relative to the handle to enable one clamp to be placed in any desired angular position relative to the other clamp and thereby enable waves and curls of various forms and shapes to be formed by the clamps and mandrels. To permit the mandrels to be adjusted angularly relative to the handle, conductive plugs on the ends of the mandrels are adapted to be telescoped in various angular positions into conductive sockets formed in the end of the handle.

6 Claims, 6 Drawing Figures

DUAL MANDREL ELECTRIC CURLING IRON WITH SEPARATE ANGULARLY ADJUSTABLE HAIR CLAMPS

BACKGROUND OF THE INVENTION

This invention relates generally to a device for curling hair and relates more particularly to that type of curling device which is commonly called a curling iron.

A conventional curling iron includes a handle, an elongated winding mandrel projecting from one end of the handle and adapted to be heated, and a clamp connected pivotally to and extending alongside the winding mandrel and adapted to clamp a lock of hair to the mandrel to enable the hair to be curled or waved. In certain curling irons, the winding mandrel is adapted to be telescoped removably into the handle and includes an internal electrical heating element adapted to plug into an electrical socket in one end of the handle. In other types of curling irons, the winding mandrel is adapted to be heated by a cartridge of butane or the like in the handle.

SUMMARY OF THE INVENTION

The general aim of the present invention is to provide a new and improved curling iron which is more versatile than prior curling irons and which is capable of forming more different types of waves and curls.

Another object of the invention is to achieve the foregoing by providing a curling iron in which two winding mandrels with separate hair clamps project from the handle in spaced side-by-side relation and in which at least one of the mandrels may be angularly adjusted so as to locate its clamp in various angular positions relative to the other clamp and thereby enable waves and curls of various shapes to be formed by the two mandrels.

The invention also resides in the novel construction of the end of the handle and the ends of the mandrels to permit the mandrels to be telescopically connected to the handle in various angular positions and to enable the heating elements to be plugged into the handle in each of those positions.

These and other objects and advantages of the invention will become more apparent from the following detailed description when taken in conjunction with the accompanying drawings.

DETAILED DESCRIPTION OF THE PREFERRED EMBODIMENT

Figure 1:
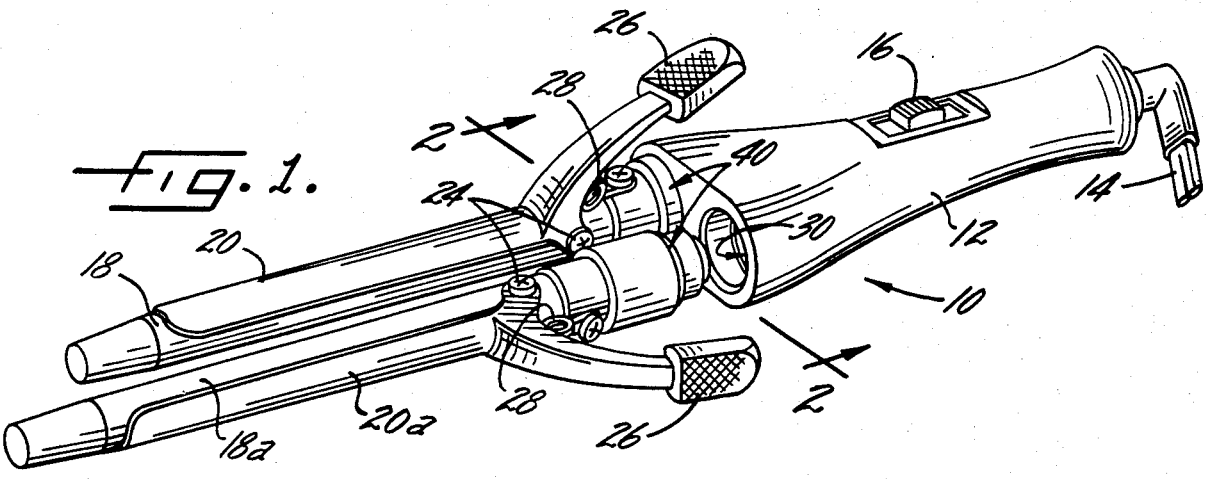
FIG. 1 is a perspective view of a new and improved curling iron incorporating the unique features of the present invention, one of the winding mandrels being exploded from the handle.

As shown in the drawings for purposes of illustration, the invention is embodied in a curling iron 10 for curling and waving hair. The specific curling iron which has been illustrated includes a generally hollow handle 12 having an electrical conductor or cord 14 extending from one of its ends, the cord being adapted for connection to a conventional 120 volt a.c. voltage source. A switch 16 is slidably supported by the handle and controls the flow of current through the cord.

The present invention contemplates the provision of an extremely versatile curling iron 10 in which two winding mandrels 18 and 18*a* with separate hair clamps 20 and 20*a* project in spaced side-by-side relation from the handle 12. At least one of the mandrels is angularly adjustable relative to the handle and thus its clamp may be set in various angular positions with respect to the clamp of the other mandrel to enable various types of curls and waves to be formed by the two mandrels.

Figure 6:
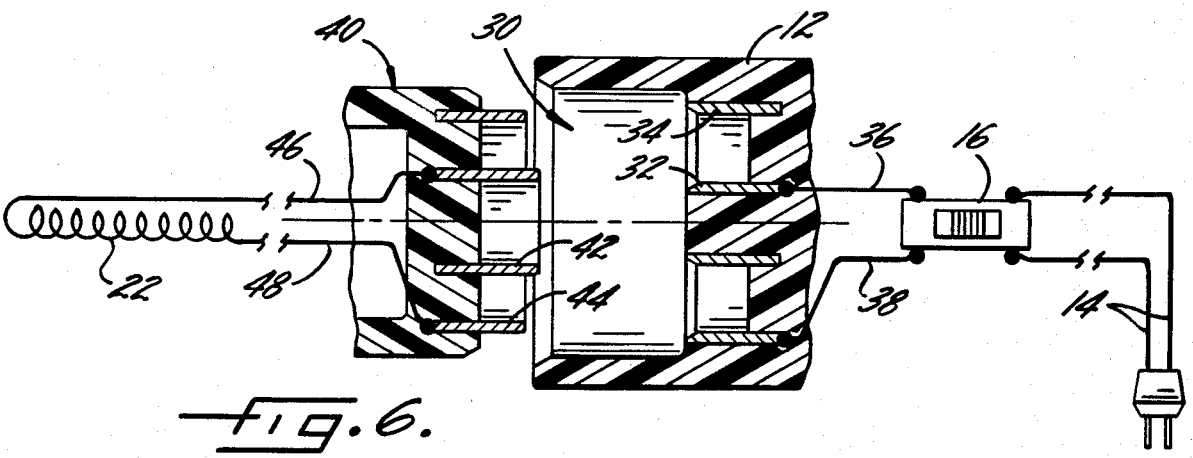
FIG. 6 is a schematic view of part of the electrical circuit of the curling iron.

For the most part, each mandrel 18, 18*a* is strictly of conventional construction and thus need not be described in detail. It will suffice to say that each mandrel is tubular and houses an electrical resistance heating element 22 (shown schematically in FIG. 6) which, when energized, is operable to heat the mandrel.

Each hair clamp 20, 20*a* is pivotally connected at 24 to the associated mandrel 18, 18*a* and extends outwardly along one side of the mandrel. By depressing a thumb lever 26 joined to the clamp, the clamp may be swung to an open position to permit a lock of hair to be placed between the clamp and the mandrel. A torsion spring 28 (FIG. 1) acts between the mandrel and the thumb lever and swings the clamp to a closed position against the mandrel when the thumb lever is released.

In carrying out the invention, coupling means are provided on the end of the handle 12 and on the ends of the mandrels 18, 18*a* to connect the mandrels and the heating elements 22 to the handle 12 and the switch 16, respectively, and to permit at least one and preferably both of the mandrels to be set in any of a plurality of angular positions relative to the handle. While the coupling means may take various forms, these means herein include a pair of identical connector sockets 30 disposed in side-by-side relation on the end portion of the handle 12 opposite the cord 14. Disposed within each socket are terminal means in the form of an inner ring 32 made of spring metal and an outer ring 34 also made of spring metal, the two rings being electrically insulated from one another. A conductor 36 within the handle 12 is connected electrically between the inner ring 32 and one side of the switch 16 while a second conductor 38 is connected electrically between the outer ring 34 and the other side of the switch.

Located on the inner end of each mandrel 18, 18*a* is a coupler in the form of a cylindrical plug-like member 40 which is sized to telescope into the associated socket 30 with a friction fit. Inner and outer terminal means or concentric rings 42 and 44 made of conductive metal are secured to the inner end of each plug member and are insulated electrically from one another. The inner ring 42 is sized to telescope snugly over the inner ring 32 of the socket 30 with a friction fit while the outer ring 44 is sized to telescope snugly with a friction fit into the outer ring 34 of the socket. A conductor 46 in the mandrel 18, 18*a* connects the inner ring 42 to one side of the heating element 22 while another conductor 48 connects the outer ring 44 to the other side of the heating element.

When the plugs 40 of the mandrels 18, 18*a* are telescoped into the sockets 30, the inner and outer rings 42 and 44 of each plug contact and are held frictionally by the inner and outer rings 32 and 34, respectively, of the socket so as to establish a circuit from the cord 14 to the heating element 22 through the switch 16. The frictional holding action of the rings and the frictional fit between each socket 30 and the mating plug 40 holds the mandrel 18, 18*a* in releasably attached relation with the handle 12, both angularly and axially. When the mandrel is manually turned, however, the frictional resistance is overcome so as to permit the angular position of the mandrel and the clamp 20 to be changed.

Figure 2:
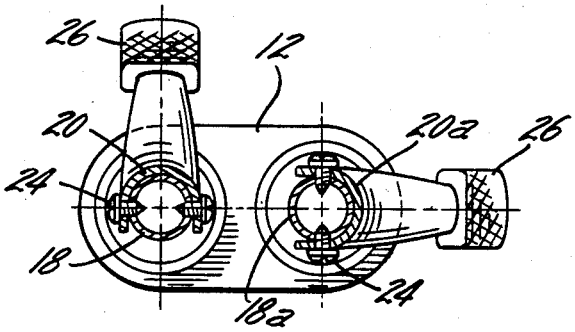
FIG. 2 is a cross-section taken substantially along the line 2—2 of FIG. 1.
Figure 3:
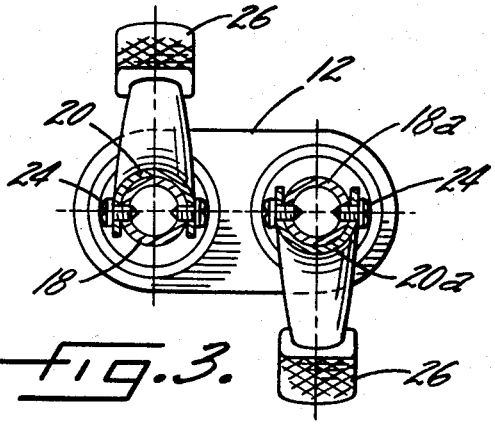
FIG. 3 is a view similar to FIG. 2 but shows one of the mandrels in a moved position.
Figure 4:
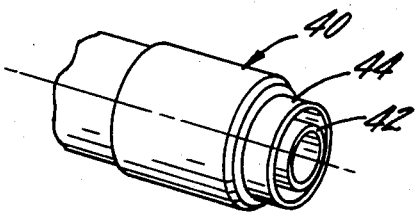
FIG. 4 is a perspective view of a connector plug on the end of one of the mandrels.
Figure 5:
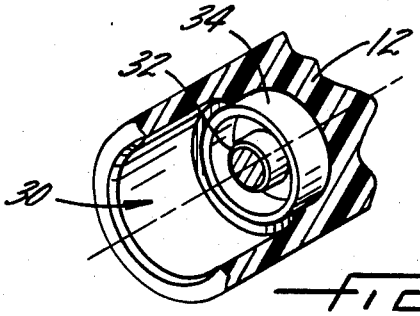
FIG. 5 is a perspective view showing one of the connector sockets on the handle and adapted to receive the plug shown in FIG. 4.

In this way, each mandrel 18, 18*a* may be positioned with its clamp 20, 20*a* in any selected angular position relative to the clamp of the other mandrel. For example, one clamp may be positioned so as to be spaced 180 degrees from the other clamp (FIG. 3), to be spaced 90 degrees from either side of the other clamp (FIG. 2) or to be located in any position in between these positions. Thus, the clamps may be located as needed to permit a lock of hair to be formed into a wave of any desired shape.

I claim:

1. A device for curling hair, said device comprising an elongated handle, a pair of elongated winding mandrels extending from one end of said handle in spaced side-by-side relation, means for heating said mandrels, a separate, independently operable hair clamp movably connected to and extending alongside each of said mandrels, and means connecting said mandrels to said one end of said handle with the clamp of one of the mandrels at a different angular orientation relative to the longitudinal axis of said handle than the clamp of the other mandrel.

2. A device as defined in claim 1 in which said connecting means permit at least one of said mandrels and the clamp connected thereto to be adjusted angularly relative to the other of said mandrels and the clamp connected thereto.

3. A device for curling hair, said device comprising a handle, conductor means on one end of said handle and adapted for connection to a voltage source, first and second elongated winding mandrels extending from the other end of said handle in spaced side-by-side relation, first and second independently operable hair clamps pivotally connected to and extending alongside said first and second mandrels, respectively, first and second electrical heating elements in said first and second mandrels, respectively, first coupling means for connecting said first mandrel and said first heating element to said handle and said conductor means, respectively, and second coupling means for connecting said second mandrel and said second heating element to said handle and said conductor means, respectively, in any of a plurality of angular positions thereby to permit said second clamp to be located at various angular positions relative to said first clamp.

4. A device as defined in claim 3 in which said first coupling means permit angular adjustment of said first mandrel and said first heating element relative to said handle and said conductor means, respectively.

5. A device for curling hair, said device comprising a handle, conductor means on one end of said handle and adapted for connection to a voltage source, a pair of side-by-side connectors on the other end of said handle, a pair of side-by-side winding mandrels each having an electrical heating element therein, a separate, independently operable hair clamp pivotally connected to and extending alongside each of said mandrels, a separate coupler on one end of each of said mandrels, said couplers being adapted to telescopically connect with said connectors in any of a plurality of angular positions to enable one of said mandrels to be positioned with its clamp located at various angular positions relative to the clamp of the other mandrel, first electrical terminal means associated with each of said connectors and connected to said conductor means, and second electrical terminal means associated with each of said couplers and connected to the heating element of the associated mandrel, said second terminal means of each coupler being located so as to electrically contact said first electrical terminal means of the respective connector when the coupler is telescopically connected with said connector in any of a plurality of angular positions.

6. A curling device as defined in claim 5 in which each of said connectors comprises a socket and in which each of said couplers comprises a plug member sized to telescope into said socket in any of a plurality of angular positions.

* * * * *